US007958829B1

(12) United States Patent
Kane et al.

(10) Patent No.: US 7,958,829 B1
(45) Date of Patent: Jun. 14, 2011

(54) SABOT

(75) Inventors: Ricky G. Kane, Aberdeen, MD (US); Mark T Ward, Abingdon, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 290 days.

(21) Appl. No.: 11/934,292

(22) Filed: Nov. 2, 2007

Related U.S. Application Data

(60) Provisional application No. 60/857,494, filed on Nov. 8, 2006.

(51) Int. Cl.
*F42B 14/06* (2006.01)

(52) U.S. Cl. ..... 102/523; 102/521; 102/520

(58) Field of Classification Search ..... 102/520, 102/521, 522, 523
See application file for complete search history.

(56) References Cited

U.S. PATENT DOCUMENTS

| | | | | |
|---|---|---|---|---|
| 2,983,224 | A | 5/1961 | Prosen et al. | |
| 3,262,391 | A | 7/1966 | Shober | |
| 3,738,279 | A * | 6/1973 | Eyre et al. | 102/521 |
| 4,215,632 | A | 8/1980 | Sie | |
| 4,535,698 | A * | 8/1985 | Yuen | 102/529 |
| 4,565,132 | A | 1/1986 | Theis | |
| 4,590,862 | A * | 5/1986 | Grabarek et al. | 102/522 |
| 4,603,636 | A | 8/1986 | Wallow | |
| H165 | H | 11/1986 | Silsby | |
| 5,012,744 | A * | 5/1991 | Sowash | 102/523 |
| 5,902,955 | A | 5/1999 | Rossmann | |
| 6,186,094 | B1 | 2/2001 | Kamdar | |
| 7,152,533 | B2 | 12/2006 | Eches et al. | |
| 7,197,984 | B2 | 4/2007 | Eches et al. | |
| 2007/0131130 | A1 * | 6/2007 | Stock et al. | 102/473 |

* cited by examiner

*Primary Examiner* — J. Woodrow Eldred
(74) *Attorney, Agent, or Firm* — William V. Adams; Christos S. Kyriakou

(57) ABSTRACT

A sabot with exactly two complimentary halves, wherein each half portion comprises teeth configured to interlock with teeth of the other half portion. The sabot may further comprise a semi-circular groove configured in the teeth of each half portion. Also, each half portion may comprise at least one indented conical end. Preferably, on each half portion, the teeth are spaced apart from the at least one indented conical end. Moreover, each half portion may comprise translucent polycarbonate material. Furthermore, each half portion may be adapted to flush mount together to form a substantially cylindrical configuration when the teeth are interlocked. Additionally, the sabot may further comprise a semi-circular groove configured in the teeth of each half portion, wherein the semi-circular groove extends to the at least one indented conical end.

20 Claims, 4 Drawing Sheets

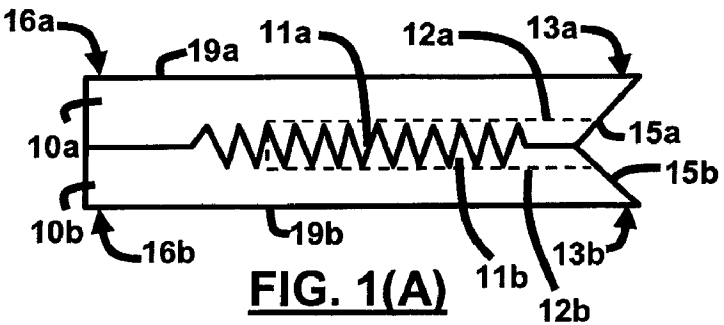
FIG. 1(A)
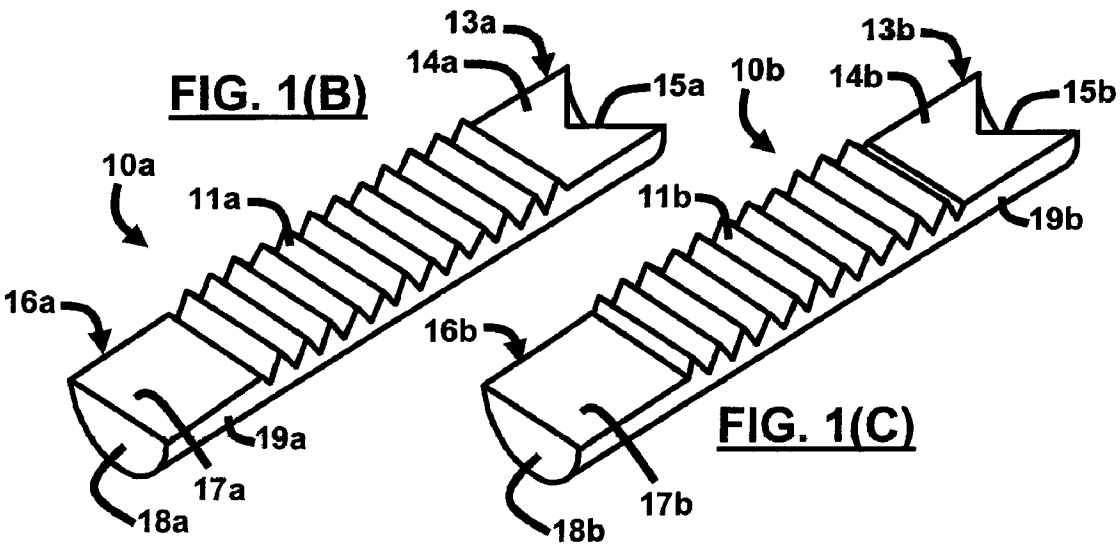
FIG. 1(B)
FIG. 1(C)

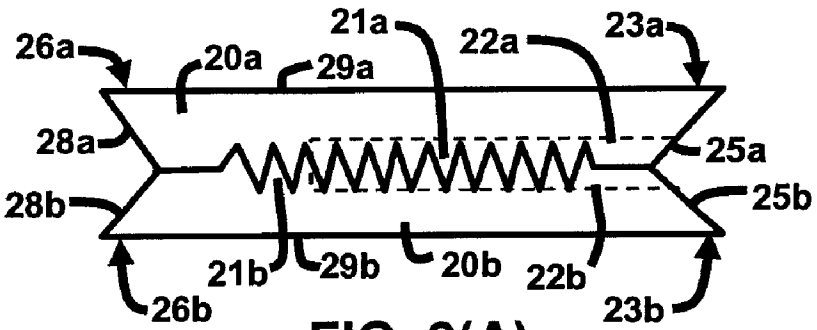
FIG. 2(A)
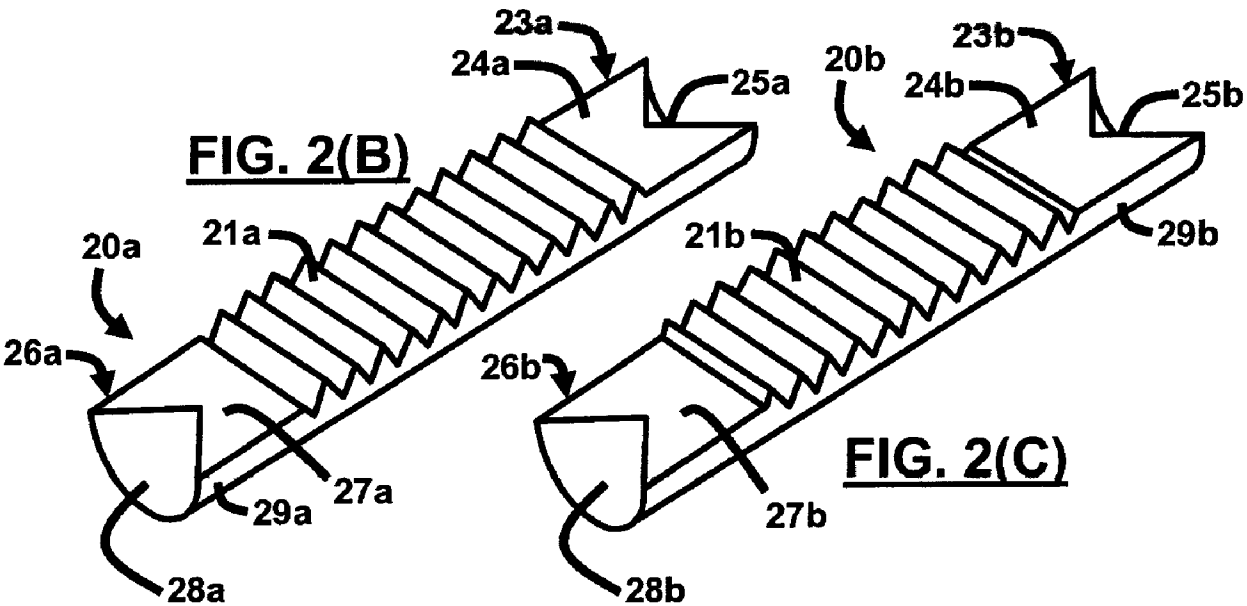
FIG. 2(B)
FIG. 2(C)

SABOT

CROSS REFERENCE TO RELATED APPLICATION

This application claims the benefit of U.S. Provisional Patent Application No. 60/857,494 filed on Nov. 8, 2006, the complete disclosure of which in its entirety is herein incorporated by reference.

GOVERNMENT INTEREST

The embodiments described herein may be manufactured, used, and/or licensed by or for the United States Government without the payment of royalties thereon.

BACKGROUND

1. Technical Field

The embodiments herein generally relate to ammunition and explosives, and, more particularly, to sabots used when firing ammunition and explosives.

2. Description of the Related Art

In military ordnance arts, carriers for projectiles, known as sabots, have been used to facilitate the firing of a variety of ammunitions. Generally, a sabot is a carrier for a projectile that permits the firing of a variety of projectiles of a smaller caliber within a larger caliber weapon. Moreover, a sabot is used to provide structured support to a projectile within a gun tube under extremely high loads. Accordingly, without adequate support from a sabot, a projectile may break up into many pieces when fired.

Typically, a sabot fills the bore of the gun tube while encasing the projectile to permit uniform and smooth firing of the weapon. Preferably, the projectile is centrally located within the sabot that is generally radially symmetrical. After firing, the sabot and projectile clear the bore of the gun tube and the sabot is normally discarded some distance from the gun tube while the projectile continues toward the target. Typically, when the sabot reaches the end of the gun barrel, the force of hitting the air pulls the sabot away from the projectile, thereby allowing the projectile to continue in flight. While several types of sabot designs are available, these designs may be overly cumbersome and may have high manufacturing costs associated with them. Moreover, typical sabots comprise three-piece configurations having smooth uniform surfaces.

Furthermore, when conventional smooth sabots (i.e., sabots with smooth surfaces and without means for holding the sabot pieces together) are used, they tend to slide back and forth in the gun barrel, which makes it difficult to line up the projectile and can create significant and unwanted pitch and yaw of the projectile. To ameliorate this situation, one could use a pusher behind the sabot. Typically, the pusher is constructed of steel and also impacts the target, which in target practice is undesirable. Furthermore, the pusher may interfere with the preferred trajectory of the projectile. Therefore, there remains a need for an improved sabot offering a low cost solution, which can be easily utilized in practice.

SUMMARY

In view of the foregoing, an embodiment provides a two-piece sabot comprising a first piece comprising a first set of raised teeth configured on a first side of the first piece; and a second piece comprising a second set of raised teeth configured on a first side of the second piece, wherein the first set of raised teeth is dimensioned and configured to interlock with the second set of raised teeth. The sabot may further comprise a groove configured in the first and second set of raised teeth. Preferably, each of the first and second pieces comprise at least one indented conical end. Also, the first set of raised teeth is preferably spaced apart from the at least one indented conical end, and the second set of raised teeth is preferably spaced apart from the at least one indented conical end. Moreover, each of the first and second pieces may comprise translucent polycarbonate material. Furthermore, the first and second pieces are preferably adapted to flush mount together to form a substantially cylindrical configuration when the first set of raised teeth is interlocked with the second set of raised teeth. Additionally, the sabot may further comprise a groove configured in the first and second set of raised teeth, wherein the groove extends to the at least one indented conical end.

Another embodiment provides a sabot comprising a first half portion comprising a first set of raised teeth configured on a first side of the first half portion, and a substantially curved surface configured on a second side of the first half portion; a second half portion comprising a first set of raised teeth configured on a first side of the second half portion, and a substantially curved surface configured on a second side of the second half portion; a semi-circular groove configured through each of the first side of the first half portion and the first side of the second half portion, wherein the first set of raised teeth is dimensioned and configured to interlock with the second set of raised teeth upon mating of the first side of the first half portion with the first side of the second half portion.

Preferably, each of the first and second half portions comprise at least one indented conical end. Moreover, the first set of raised teeth is preferably spaced apart from the at least one indented conical end, and the second set of raised teeth is preferably spaced apart from the at least one indented conical end. Furthermore, each of the first and second half portions may comprise translucent polycarbonate material. Also, the first and second half portions are preferably adapted to flush mount together to form a substantially cylindrical configuration when the first set of raised teeth is interlocked with the second set of raised teeth. Additionally, the semi-circular groove may be configured in each of the first and second set of raised teeth, wherein the semi-circular groove preferably extends to the at least one indented conical end.

Another embodiment provides a sabot comprising exactly two complimentary halves, wherein each half portion comprises teeth configured to interlock with teeth of the other half portion. The sabot may further comprise a semi-circular groove configured in the teeth of each half portion. Also, each half portion may comprise at least one indented conical end. Preferably, on each half portion, the teeth are spaced apart from the at least one indented conical end. Moreover, each half portion may comprise translucent polycarbonate material. Furthermore, each half portion may be adapted to flush mount together to form a substantially cylindrical configuration when the teeth are interlocked. Additionally, the sabot may further comprise a semi-circular groove configured in the teeth of each half portion, wherein the semi-circular groove extends to the at least one indented conical end.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which FIG. 1(A) illustrates a schematic diagram of an interlocking sabot according to a first embodiment herein;

FIGS. 1(B) and 1(C) illustrate schematic diagrams of each interlocking sabot half, respectively, of FIG. 1(A) according to a first embodiment herein;

FIG. 2(A) illustrates a schematic diagram of an interlocking sabot according to a second embodiment herein;

FIGS. 2(B) and 2(C) illustrate schematic diagrams of each interlocking sabot half, respectively, of FIG. 2(A) according to a second embodiment herein;

DETAILED DESCRIPTION OF PREFERRED EMBODIMENTS

Figure 1D:
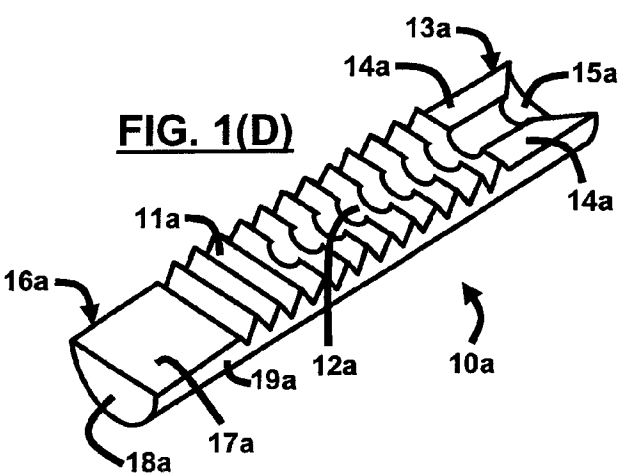
FIGS. 1(D) and 1(E) illustrate schematic diagrams of the interlocking sabot halves of FIGS. 1(B) and 1(C), respectively, with a groove configured therein according to a first embodiment herein.
Figure 1E:
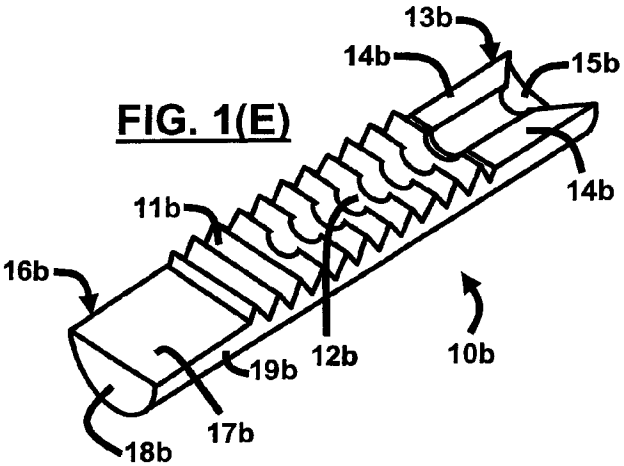

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there remains a need for an improved sabot offering a low cost solution, which can be easily utilized in practice. The embodiments herein achieve this by providing a two-piece sabot which can be configured in a large quantity mass production easily and at a low cost. Referring now to the drawings, and more particularly to FIGS. 1(A) through 2(I), where similar reference characters denote corresponding features consistently throughout the figures, there are shown preferred embodiments.

FIGS. 1(A) through 1(I) illustrate a first embodiment herein and FIGS. 2(A) through 2(I) illustrate a second embodiment herein. The sabot 10 (of the first embodiment shown in FIG. 1(A)) and the sabot 20 (of the second embodiment shown in FIG. 2(A)) each consists of exactly two complimentary pieces rather than three or more pieces as with some conventional sabots. Each sabot 10, 20 comprises interlocking sabot halves 10*a*, 10*b* and 20*a*, 20*b*, respectively, so that no pusher is required to hold the sabot halves 10*a*, 10*b* and 20*a*, 20*b* together. This configuration prevents damage to the target (not shown) from pusher impact. Moreover, each sabot 10, 20 may be used for practice rounds in 30 mm, 20 mm, 50 caliber, and .458 caliber guns (not shown), for example. During use, the sabot 10, 20 falls away from the projectile (i.e., bullet) (not shown) before hitting the target. As a result, the target is not damaged by sabot collisions.

Figure 1F:
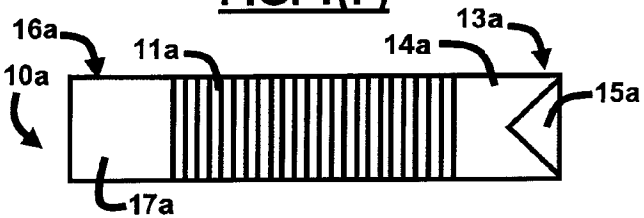
FIG. 1(F) illustrates a top view of the sabot half of FIG. 1(B) according to a first embodiment herein.
Figure 1H:
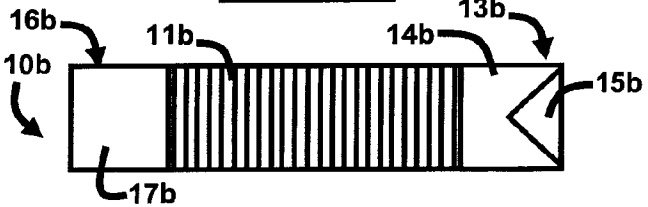
FIG. 1(H) illustrates a top view of the sabot half of FIG. 1(C) according to a first embodiment herein.
Figure 1G:
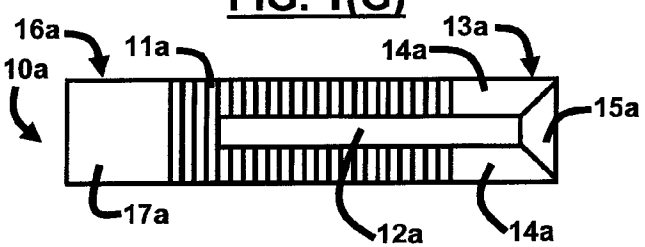
FIG. 1(G) illustrates a top view of the sabot half of FIG. 1(D) according to a first embodiment herein.
Figure 1I:
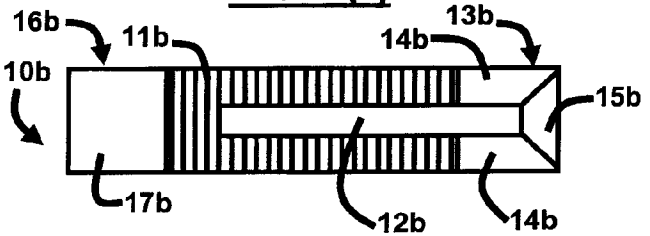
FIG. 1(I) illustrates a top view of the sabot half of FIG. 1(E) according to a first embodiment herein.

FIGS. 1(B) and 1(C) each illustrate complimentary halves of the sabot 10 (of FIG. 1(A)) according to a first embodiment herein. FIGS. 1(F) and 1(H) illustrate the top views of FIGS. 1(B) and 1(C), respectively. Each complementary sabot half 10*a*, 10*b* is generally configured as an elongated half-cylindrical structure comprising a first end 13*a*, 13*b* opposite a second end 16*a*, 16*b* and having a substantially curved surface 19*a*, 19*b*. Oppositely positioned from the curved surface 19*a*, 19*b* is a series of teeth 11*a*, 11*b* extending outwardly from the open-faced sabot halves 10*a*, 10*b* such that the teeth 11*a* of sabot half 10*a* mate with the teeth 11*b* of sabot half 10*b*. This mating of the teeth 11*a*, 11*b* is best illustrated in FIG. 1(A).

Additionally, each sabot half 10*a*, 10*b* has a conical indentation 15*a*, 15*b* at a first end 13*a*, 13*b* and has a flat surface 18*a*, 18*b* on the second end 16*a*, 16*b*. Because the sabot halves 10*a*, 10*b* are semi-cylindrically configured, the flat surface 18*a*, 18*b* assumes a semi-circular shape. The conical indentation 15*a* is separated from the teeth 11 a by a top portion 14*a* that is substantially flat to flush mate with the corresponding top portion 14*b* of sabot half 10*b*. Similarly, the conical indentation 15*b* is separated from the teeth 11*b* by a top portion 14*b* that is substantially flat to flush mate with the corresponding top portion 14*a* of sabot half 10*a*. Likewise, the flat surface 18*a* is separated from the teeth 11*a* by a top portion 17*a* that is substantially flat to flush mate with the corresponding top portion 17*b* of sabot half 10*b*, and the flat surface 18*b* is separated from the teeth 11*b* by a top portion 17*b* that is substantially flat to flush mate with the corresponding top portion 17*a* of sabot half 10*a*. A groove 12*a*, 12*b* may be configured from the conical end 15*a*, 15*b* and extending through the teeth 11*a*, 11*b* of the sabot halves 10*a*, 10*b* as shown in FIGS. 1(D), 1(E), 1(G), and 1(I) such that the groove 12*a*, 12*b* creates a bifurcated top portion 14*a*, 14*b*. This groove 12*a*, 12*b* may be formed by drilling and is configured to accommodate a bullet (not shown).

Figure 2D:
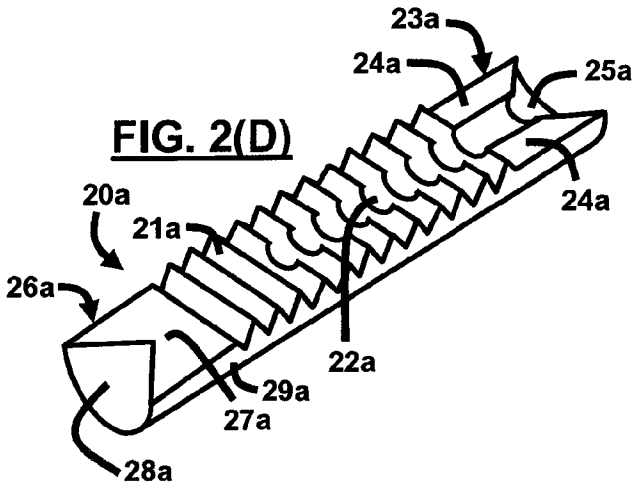
FIGS. 2(D) and 2(E) illustrate schematic diagrams of the interlocking sabot halves of FIGS. 2(B) and 2(C), respectively, with a groove configured therein according to a second embodiment herein.
Figure 2E:
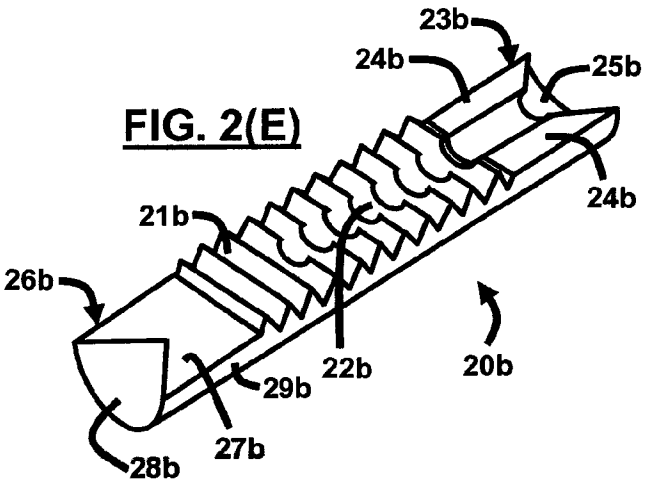
Figure 2F:
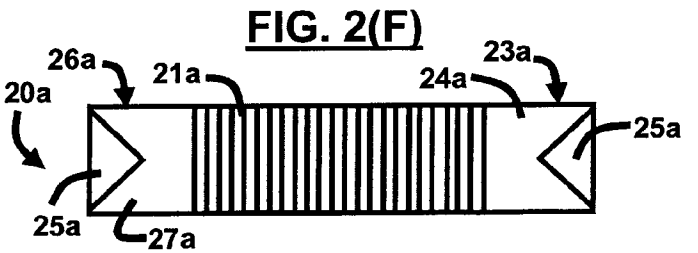
FIG. 2(F) illustrates a top view of the sabot half of FIG. 2(B) according to a second embodiment herein.
Figure 2H:
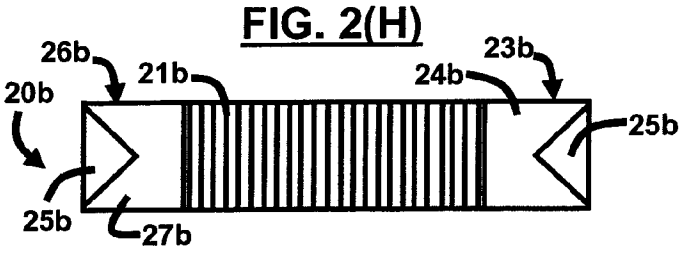
FIG. 2(H) illustrates a top view of the sabot half of FIG. 2(C) according to a second embodiment herein.
Figure 2G:
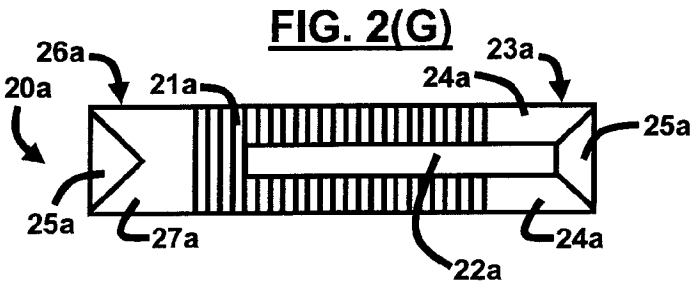
FIG. 2(G) illustrates a top view of the sabot half of FIG. 2(D) according to a second embodiment herein.
Figure 2I:
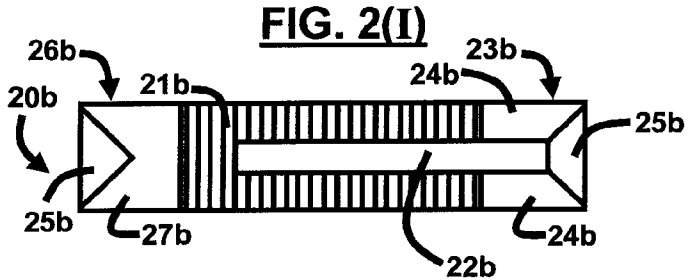
FIG. 2(I) illustrates a top view of the sabot half of FIG. 2(E) according to a second embodiment herein.

FIGS. 2(B) and 2(C) each illustrate complimentary halves of the sabot 20 (of FIG. 2(A)) according to a second embodiment herein. FIGS. 2(F) and 2(H) illustrate the top views of FIGS. 2(B) and 2(C), respectively. Each complementary sabot half 20*a*, 20*b* is generally configured as an elongated half-cylindrical structure comprising a first end 23*a*, 23*b* opposite a second end 26*a*, 26*b* and having a substantially curved surface 29*a*, 29*b*. Oppositely positioned from the curved surface 29*a*, 29*b* is a series of teeth 21*a*, 21*b* extending outwardly from the open-faced sabot halves 20*a*, 20*b* such that the teeth 21*a* of sabot half 20*a* mate with the teeth 21*b* of sabot half 20*b*. This mating of the teeth 21*a*, 21*b* is best illustrated in FIG. 2(A).

Furthermore, each sabot half 20*a*, 20*b* provides a conical indentation 25*a*, 25*b*, 28*a*, 28*b* at both the first ends 23*a*, 23*b* and second ends 26*a*, 26*b*, respectively. The conical indentation 25*a* is separated from the teeth 21*a* by a top portion 24*a* that is substantially flat to flush mate with the corresponding top portion 24*b* of sabot half 20*b*. Similarly, the conical indentation 25*b* is separated from the teeth 21*b* by a top portion 24*b* that is substantially flat to flush mate with the corresponding top portion 24*a* of sabot half 20*a*. Likewise, the conical indentation 28*a* is separated from the teeth 21*a* by a top portion 27*a* that is substantially flat to flush mate with the corresponding top portion 27*b* of sabot half 20*b*, and the conical indentation 28*b* is separated from the teeth 21*b* by a top portion 27*b* that is substantially flat to flush mate with the corresponding top portion 27*a* of sabot half 20*a*. A groove 22*a*, 22*b* may be configured from the conical end 25*a*, 25*b* and extending through the teeth 21*a*, 21*b* of the sabot halves 20*a*, 20*b* as shown in FIGS. 2(D), 2(E), 2(G), and 2(I) such that the groove 22*a*, 22*b* creates a bifurcated top portion 24*a*, 24*b*. This groove 22*a*, 22*b* may be formed by drilling and is configured to accommodate a bullet (not shown).

The sabot 10, 20 may comprise rigid polycarbonate material, and preferably, the polycarbonate is translucent, so that longitudinal drilling of the groove 12*a*, 12*b*, 22*a*, 22*b* can be observed through the assembled sabot 10, 20 (as best shown by the dashed lines in FIGS. 1(A) and 2(A), respectively). Polycarbonate material is preferred because it is softer than barrel metal so that it does not cause barrel wear. However, other materials may be used for the sabot 10, 20 that have substantially equivalent material properties. Furthermore, the sabot 10, 20 may have a length between 20-30 mm.

Preferably, the diameter of the projectile (i.e., bullet) is less than the diameter of the sabot 10, 20. In flight, according to the first embodiment, the conical indentation 15*a*, 15*b* leads and the flat surface 18*a*, 18*b* follows. Moreover, in flight, according to the second embodiment, the conical indentation 25*a*, 25*b* leads and the conical indentation 28*a*, 28*b* follows. After leaving the barrel (not shown), the conical indentation 15*a*, 15*b*, 25*a*, 25*b* catches the air and the sabot 10, 20 splits into the two component pieces (sabot halves 10*a*, 10*b* in the first embodiment and sabot halves 20*a*, 20*b* in the second embodiment) that fall away from the projectile (not shown). Preferably, the conical indentations 15*a*, 15*b*, 25*a*, 25*b*, 28*a*, 28*b* are inwardly configured into the sabot halves 10*a*, 10*b*, 20*a*, 20*b*, respectively, such that the maximum diameter of an assembled sabot 10, 20 is defined by the curved surfaces 19*a*, 19*b*, 29*a*, 29*b* to create a substantially cylindrical body when the sabot 10, 20 is assembled. The two component pieces (sabot halves 10*a*, 10*b* in the first embodiment and sabot halves 20*a*, 20*b* in the second embodiment) of the sabot 10, 20 do not continue on the trajectory with the projectile and do not impact the target. As a result, the sabot 10, 20 does not strike the target, or otherwise interfere with the trajectory or impact of the projectile.

The embodiments herein provide a novel sabot 10, 20 compared with conventional sabots. The interlocking teeth 11*a*, 11*b*, 21*a*, 21*b* hold the two-part sabot 10, 20 together locking the sabot 10, 20 inside a gun barrel (not shown). Comparatively, when conventional smooth sabots (i.e., sabots with smooth surfaces and without means for holding the sabot pieces together (such as interlocking teeth)) are used, they tend to slide back and forth in the gun barrel, which makes it difficult to line up the projectile and create significant and unwanted pitch and yaw of the projectile. Accordingly, the sabot 10, 20 provided by the embodiments herein eliminates this problem.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A two-piece sabot comprising:

a first piece comprising a first set of raised teeth configured on a first side of said first piece; and a second piece comprising a second set of raised teeth configured on a first side of said second piece, wherein said first set of raised teeth is dimensioned and configured to interlock with said second set of raised teeth and the first piece and the second piece form a cylindrical structure that separates into two pieces after the sabot leaves the barrel of a weapon and wherein said two piece sabot is solid through a cross-section thereof when the first piece and the second piece are joined into a cylindrical structure.

2. The sabot of claim 1, further comprising a groove configured in the first and second set of raised teeth.

3. The sabot of claim 1, wherein each of the first and second pieces comprise a portion of at least one indented conical end.

4. The sabot of claim 3, wherein said first set of raised teeth is spaced apart from said portion of at least one indented conical end, and wherein said second set of raised teeth is spaced apart from said portion of at least one indented conical end.

5. The sabot of claim 1, wherein each of the first and second pieces comprise translucent polycarbonate material.

6. The sabot of claim 1, wherein the first and second pieces are adapted to flush mount together to form a substantially elongated cylindrical configuration when said first set of raised teeth is interlocked with said second set of raised teeth.

7. The sabot of claim 3, further comprising a groove configured in the first and second set of raised teeth, and wherein said groove extends to said portion of at least one indented conical end.

8. A sabot comprising:

a first half-cylindrical portion comprising a first set of raised teeth configured on a first side of said first half portion, and a substantially curled surface configured on a second side of said first half portion;

a second complementary half-cylindrical portion comprising a first set of raised teeth configured on a first side of said second half portion, and a substantially curved surface configured on a second side of said second half portion;

a semi-circular groove configured through each of said first side of said first half portion and said first side of said second half portion, wherein said first set of raised teeth is dimensioned and configured to interlock with said second set of raised teeth upon mating of said first side of said first half portion with said first side of said second half portion and the first half-cylindrical portion and the second complementary half-cylindrical portion form an elongated cylindrical structure wherein said first half-cylindrical portion and said second half-cylindrical portion mate such that the combination of said first half-cylindrical portion and said second half-cylindrical portion is solid through a cross-section thereof.

9. The sabot of claim 8, wherein each of the first and second half portions comprise a portion of at least one indented conical end.

10. The sabot of claim 9, wherein said first set of raised teeth is spaced apart from said at least one indented conical end, and wherein said second set of raised teeth is spaced apart from said portion of at least one indented conical end.

11. The sabot of claim 8, wherein each of the first and second half portions comprise translucent polycarbonate material.

12. The sabot of claim 8, wherein the first and second half portions are adapted to flush mount together to form a substantially cylindrical configuration when said first set of raised teeth is interlocked with said second set of raised teeth.

13. The sabot of claim 9, wherein said semi-circular groove is configured in each of the first and second set of raised teeth, and wherein said semi-circular groove extends to said portion of at least one indented conical end.

14. A sabot consisting of two complimentary half portions, wherein each half portion comprises teeth configured to interlock with teeth of the other half portion.

15. The sabot of claim 14, further comprising a semi-circular groove configured in the teeth of said each half portion.

16. The sabot of claim 14, wherein said each half portion comprises a portion of at least one indented conical end.

17. The sabot of claim 16, wherein on said each half portion, said teeth is spaced apart from said portion of at least one indented conical end.

18. The sabot of claim 14, wherein said each half portion comprises translucent polycarbonate material.

19. The sabot of claim 14, wherein said each half portion is adapted to flush mount together to form a substantially cylindrical configuration when said teeth are interlocked.

20. The sabot of claim 16, further comprising a semi-circular groove configured in the teeth of said each half portion, and wherein said semi-circular groove extends to said at least one indented conical end.

* * * * *